US011793724B2

(12) United States Patent
Jung

(10) Patent No.: US 11,793,724 B2
(45) Date of Patent: Oct. 24, 2023

(54) GELATIN SUPPLY DEVICE FOR SOFTGEL ENCAPSULATION MACHINE

(71) Applicant: Soo-Yeong Jung, Siheung-si (KR)

(72) Inventor: Soo-Yeong Jung, Siheung-si (KR)

( * ) Notice: Subject to any disclaimer, the term of this patent is extended or adjusted under 35 U.S.C. 154(b) by 1139 days.

(21) Appl. No.: 16/508,808

(22) Filed: Jul. 11, 2019

(65) Prior Publication Data

US 2020/0054526 A1 Feb. 20, 2020

(30) Foreign Application Priority Data

Aug. 16, 2018 (KR) ..... 10-2018-0095267
Apr. 22, 2019 (KR) ..... 10-2019-0046487

(51) Int. Cl.

| | |
|---|---|
| ***A61J 3/07*** | (2006.01) |
| ***A61J 3/00*** | (2006.01) |
| ***B41F 17/36*** | (2006.01) |

(52) U.S. Cl.

CPC ..... *A61J 3/077* (2013.01); *A61J 3/007* (2013.01); *B41F 17/36* (2013.01); *A61J 3/07* (2013.01)

(58) Field of Classification Search

CPC ..... A61J 3/077
See application file for complete search history.

(56) References Cited

FOREIGN PATENT DOCUMENTS

| | | |
|---|---|---|
| JP | 01232963 | 9/1989 |
| JP | 4219240 | 2/2009 |
| KR | 20070053136 | 5/2007 |
| KR | 2020090010357 | * 10/2009 |
| KR | 200448172 | 3/2010 |
| KR | 20120033921 | 4/2012 |
| KR | 101792195 | 10/2017 |

* cited by examiner

*Primary Examiner* — John S Kenyon
(74) *Attorney, Agent, or Firm* — CANTOR COLBURN LLP

(57) ABSTRACT

Provided is a gelatin supply device for a softgel encapsulation machine, the device having multiple spreader boxes provided on a guide having adjustment holes arranged in an arc shape to form multiple gelatin sheets, the device being further provided with a printing unit between the provided spreader boxes to print an information mark on an upper surface of a gelatin sheet while forming the gelatin sheet, the device forming a shell of a capsule by covering the information mark with another gelatin sheet.

10 Claims, 10 Drawing Sheets

GELATIN SUPPLY DEVICE FOR SOFTGEL ENCAPSULATION MACHINE

BACKGROUND OF THE INVENTION

Field of the Invention

The present invention relates to a gelatin supply device supplying gelatin to manufacture a soft capsule by multi-layering gelatin sheets serving as a shell of the soft capsule, the device providing an information mark on the soft capsule on a gelatin sheet.

In addition, the present invention relates to a gelatin supply device equipped with multiple spreader boxes to form multi-ply gelatin sheets, the gelatin supply device having a structure in which the multiple spreader boxes are efficiently mounted in a conventional limited space, and easily controlling the thickness of liquid gelatin while supplying the liquid gelatin in the form of a sheet.

Furthermore, the present invention relates to a gelatin supply device for a softgel encapsulation machine, the device equipped with a printing unit provided between the spreader boxes provided to form the multi-ply gelatin sheets, providing the information mark on a surface of the gelatin sheet in a process of forming the gelatin sheet, and covering the information mark with another gelatin sheet such that a multi-ply capsule shell is formed.

Description of the Related Art

A general method of manufacturing soft capsule products which are applied for various purposes is performed by heating gelatin to be dissolved, thinly spreading the gelatin on a drum of a softgel encapsulation machine, transporting the gelatin to a molding portion, and molding soft capsules using a pair of molding rolls while filling the inside with a medicine.

Such soft capsules are generally manufactured by using a rotary type machine. More specifically, the apparatus includes: a sheet forming portion 1 forming a thin film-like gelatin sheet with a gelatin solution; a capsule molding portion 2 molding a capsule with the gelatin sheet; and a liquid medicine supply portion 3 supplying a liquid medicine into the gelatin sheet.

The sheet forming portion 1 will be described with reference to FIG. 1. The gelatin which has been changed to a syrup form in a gelatin tank, that is, in a liquid form, is supplied to spreader boxes (B) connected to the storage tank through transfer hoses. The melted gelatin, which is pumped in the storage tank and supplied to the spreader boxes through the transfer hoses, is adjusted in thickness and applied in the adjusted thickness onto each outer circumferential surface of drums (D) disposed below the sheet forming portion 1.

Then, the gelatin applied to the rotating drums is cooled and sheeted, and then supplied to the capsule molding portion via multiple conveying rollers (R).

In the above procedure, the spreader boxes, the storage tank, and the transfer hoses may be referred to as a gelatin supply device.

In order to mold the shell of the soft capsule, the capsule molding portion 2 is provided with a pair of molding rolls (R2) configured with cavities engraved in a half of a shape of the capsule and arranged on an outer circumferential surface of each molding rolls (R2) in a manner corresponding to cavities of the pair molding roll and rotating in opposite directions. A wedge (W) is mounted on the molding rolls (R2) to inject the liquid medicine, and the wedge (W) is connected to the liquid medicine supply portion 3 in order to be supplied with the liquid medicine.

The two gelatin sheets formed in the sheet forming portion are sandwiched between the pair of rotating molding rolls of the capsule forming portion and the liquid medicine is injected between the gelatin sheets at a constant cycle. Then, the gelatin sheets are heat-sealed and cut so that the gelatin sheets are formed into a capsule shape by the pair of molding rolls. Accordingly, it is possible to continuously produce the soft capsules filled with the liquid medicine in the gelatin sheets.

Since the one gelatin sheet is formed in the sheet forming portion, a shell of the soft capsule has a single layer.

In the case the shell of the soft capsule has a single layer, when molding a soft capsule in which a medicine having a special purpose is formed as a capsular shell, the special medicine may be prepared as a liquid type, and the special liquid medicine may be sprayed onto an outer surface of the molded soft capsule to form an outer skin additionally.

However, spraying the special liquid medicine onto the outer surface of the soft capsule is not recommended because the workability is low and the liquid medicine may be lost during being sprayed.

Soft capsules to be produced are required to be printed with lot numbers or characters of the medicine for informing the consumer. In the conventional case, the printing of the lot numbers or the like on the soft capsules is performed through multiple processes including putting the soft capsules into a separate device after forming the soft capsules through the softgel encapsulation machine. However, there are problems in that it is costly and operation efficiency is low.

In the process of molding the soft capsules, oil is applied to the entire surfaces of the gelatin sheets defining the outer surfaces of the capsules before filling the inside the capsules with the contents of the medicine or the like. However, this oil remains on the surfaces of the capsules even after drying process of the soft capsules, and it is difficult to print lot numbers on the surfaces of the soft capsule shells on which the oil still remains, whereby a separate washing process is required.

In order to solve such problems with respect to workability and cost, related arts are provided: SOFT CAPSULE WASHING APPARATUS AND PRINTING APPARATUS HAVING THEREOF disclosed in Korean Patent No. 10-1792195, issued on Oct. 25, 2017; and APPARATUS FOR MANUFACTURING OF SOFT CAPSULE HAVING PRINT FUNCTION disclosed in Korean Patent Application Publication No. 10-2012-0033921.

Korean Patent No. 10-1792195 proposes the apparatus capable of cleaning oil remaining on outer surfaces of soft capsules and printing thereon, and Korean Patent Application Publication No. 10-2012-0033921 is characterized in that a printer and a drying device are provided around a drum of a sheet forming unit that forms a gelatin sheet.

In particular, Korean Patent Application Publication No. 10-2012-0033921 is in common with the present invention to be described below in that the printer is mounted on the sheet forming unit to print information such as lot numbers in the process of forming a gelatin sheet. However, in Korean Patent Application Publication No. 10-2012-0033921, printing on a gelatin sheet is performed in a separate manner from spreader boxes that supply liquid gelatin to form a sheet, and the operation such as printing of lot numbers is not closely linked with the process of forming a gelatin sheet.

In addition, the apparatus disclosed in Korean Patent Application Publication No. 10-2012-0033921 is not as compact as a configuration of a device to be described in the present invention.

Japanese Patent No. 4219240 issued on Nov. 21, 2008 discloses METHOD AND APPARATUS FOR MANUFACTURING SOFT CAPSULE HAVING DOUBLE LAYER SHELL. A configuration capable of forming a multi-ply capsule shell is provided, but the operation of the apparatus and the manufacture of the product have limitations compared with the configuration proposed by the present invention.

SUMMARY OF THE INVENTION

Accordingly, the present invention has been made keeping in mind the above problems occurring in the related art.

First, the present invention is intended to provide a gelatin supply device for a softgel encapsulation machine, the device forming a multi-ply shell of a capsule.

In particular, the present invention is intended to provide a gelatin supply device installed in a limited space and controlling timing at which a gelatin sheet is discharged in accordance with a state of gelatin sheets constituting the multi-ply shell.

In addition, the present invention is intended to provide a gelatin supply device supplying a predetermined amount of liquid gelatin to a spreader box and controlling the amount of supplied liquid gelatin without the need of the conventional complicated structure.

Second, the present invention is intended to provide a gelatin supply device printing an information mark including lot numbers of a product on a gelatin sheet in the process of forming the multiple gelatin sheets.

In particular, the present invention is intended to provide a gelatin supply device having a structure in which the process of printing the information mark and the process of forming the gelatin sheet are closely linked to each other in accordance with an operation situation.

In order to achieve an objective of the present invention, there is provided a gelatin supply device for a softgel encapsulation machine, the device including: spreader boxes supplying the liquid gelatin in the form of a sheet; a storage tank where the liquid gelatin is stored; and a transfer hose through which the stored liquid gelatin is transferred to the spreader boxes.

At least two spreader boxes are provided to form multiple gelatin sheets.

The at least two spreader boxes are provided on a guide provided on an upper surface of the drum, and adjustment holes configured in the guide are arranged in an arc shape being concentric with the drum such that the spreader boxes provided on the guide are moved due to the adjustment holes to adjust a distance between the spreader boxes.

The gelatin supply device may further include a printing unit between the spreader boxes to print an information mark such that the information mark is positioned between gelatin sheets.

The above-described gelatin supply device for a softgel encapsulation machine has the following effects.

A multi-ply shell of a capsule can be formed. In particular, a structure in which multiple spreader boxes are disposed on an upper surface of one drum to form multiple gelatin sheets is employed such that it is possible to form the multiple gelatin sheets while maintaining the size of the conventional softgel encapsulation machine whereby there is no space limitation in accordance with use of the softgel encapsulation machine.

In addition, it is possible to supply and control a predetermined amount of liquid gelatin without the need of the complicated structure employed in the conventional gelatin supply device.

A distance between the spreader boxes provided on the guide can be adjusted so that the speed at which the multiple gelatin sheets are formed can be controlled with reference to a state of formed gelatin sheets.

In addition, an information mark is printed on the gelatin sheet in the process of forming the multiple gelatin sheets and the information mark is positioned between the gelatin sheets. Accordingly, an outer-ply shell protects the information mark so that it is possible to prevent damage to the information mark in the process of manufacturing the soft capsule and deliver the accurate information to consumers.

In addition, since damage to the information mark is prevented, it is possible to use a liquid medicine component as a material forming the information mark.

Furthermore, a printing unit is provided on the guide together with the spreader boxes, and a position of the printing unit and distances between the printing unit and the spreader boxes can be adjusted by the guide. Accordingly, the molding and forming process of the gelatin sheets can be finely controlled in accordance with the gelatin sheet molding state or the information mark forming state.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Hereinafter, a gelatin supply device for a softgel encapsulation machine according to the present invention will be described in detail with reference to the accompanying drawings.

Generally, soft capsules are prepared by heating gelatin to be dissolved and thinly spreading the gelatin such that a gelatin sheet is obtained and used as a shell. The device according to the present invention is described with respect to a softgel capsule or a gelatin sheet. However, the shell of the soft capsule is not limited to a gelatin material.

As described above, the gelatin supply device for a softgel encapsulation machine according to the present invention differs from the conventional softgel encapsulation machine with respect to the structure of the sheet forming portion, particularly, the vicinity structure including the spreader boxes, but most configurations of the conventional softgel encapsulation machine are adopted.

Figure 2:
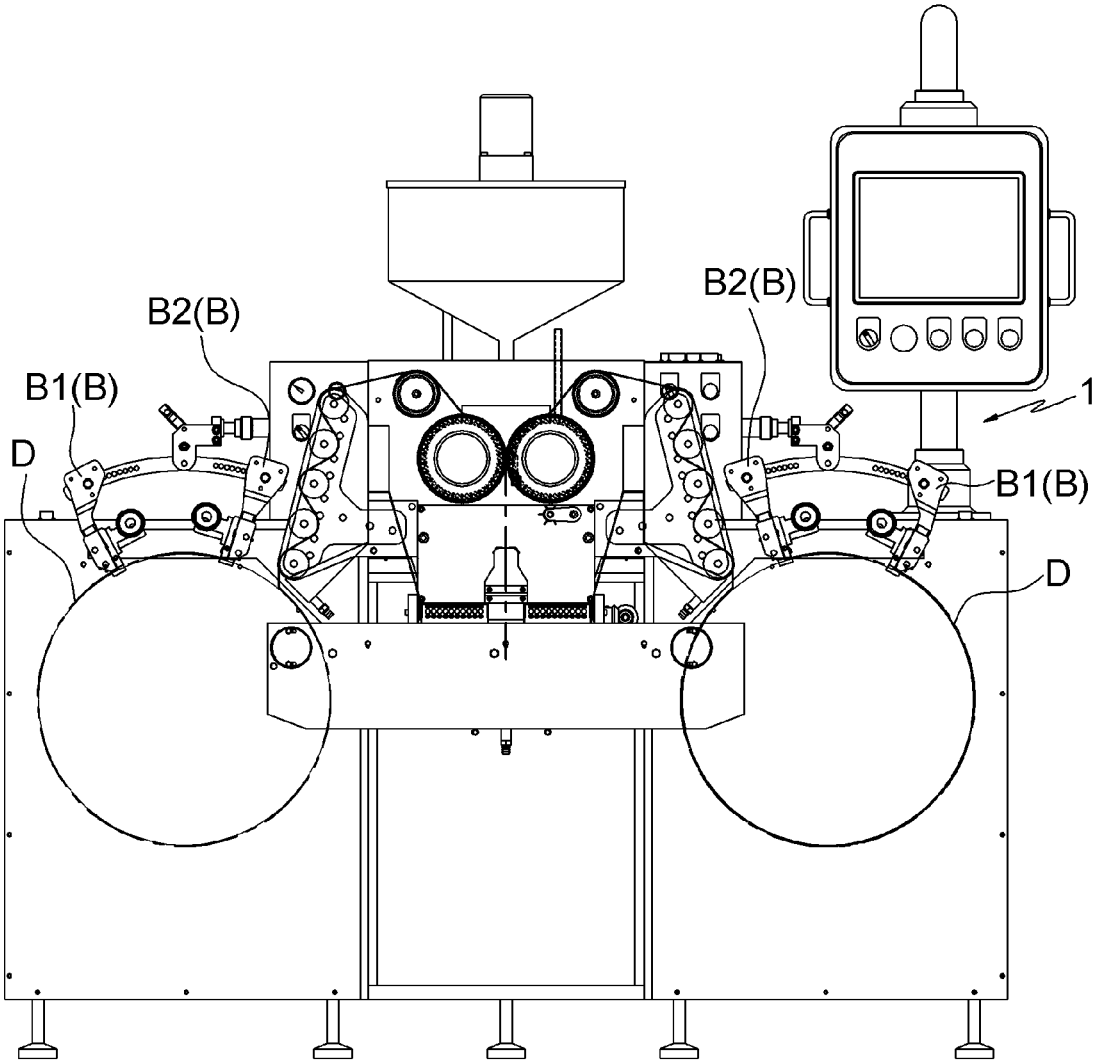
FIG. 2 is a schematic view illustrating a softgel encapsulation machine equipped with a gelatin supply device according to the present invention.

Referring to FIG. 2, the gelatin supply device according to the present invention is also equipped in the conventional softgel encapsulation machine.

The softgel encapsulation machine includes: a sheet forming portion 1 forming a thin film-like gelatin sheet with a gelatin solution; a capsule molding portion 2 molding a capsule with the gelatin sheet; and a liquid medicine supply portion 3 supplying a liquid medicine into the gelatin sheet.

The sheet forming portion is provided with the gelatin supply device having spread boxes (B) to supply liquid gelatin in the form of a sheet. The gelatin discharged from the spreader boxes in the form of a sheet is applied in an adjusted thickness onto each outer circumferential surface of drums D disposed below the sheet forming portion. Then, the gelatin is cooled, sheeted, and supplied to the capsule molding portion.

A shell of a soft capsule manufactured by the conventional softgel encapsulation machine is single-ply. On the other hand, according to the present invention, the gelatin sheet to be put into the capsule molding portion is multi-ply so that a soft capsule having a multi-ply shell can be finally obtained. It is the important point of the present invention that the gelatin supply device has the spreader boxes forming the multi-ply shell.

Accordingly, the gelatin supply device according to the present invention has the following configuration.

In detail, the gelatin supply device according to the present invention includes: the spreader boxes (B) supplying the liquid gelatin in the form of a sheet as the gelatin supply device of the conventional softgel encapsulation machine does; a storage tank (not illustrated) where the liquid gelatin is stored; and transfer hoses (H) through which the stored liquid gelatin is supplied to the spreader boxes.

In addition, the two or more spreader boxes are provided in the gelatin supply device to supply the liquid gelatin in the form of a sheet onto each outer circumferential surface of the drums of the sheet forming portion.

That is, the spreader boxes are arranged in the vicinity of the outer circumferential surfaces of the drums to directly supply the sheeted liquid gelatin to the outer circumferential surfaces of the drums.

Figure 1:
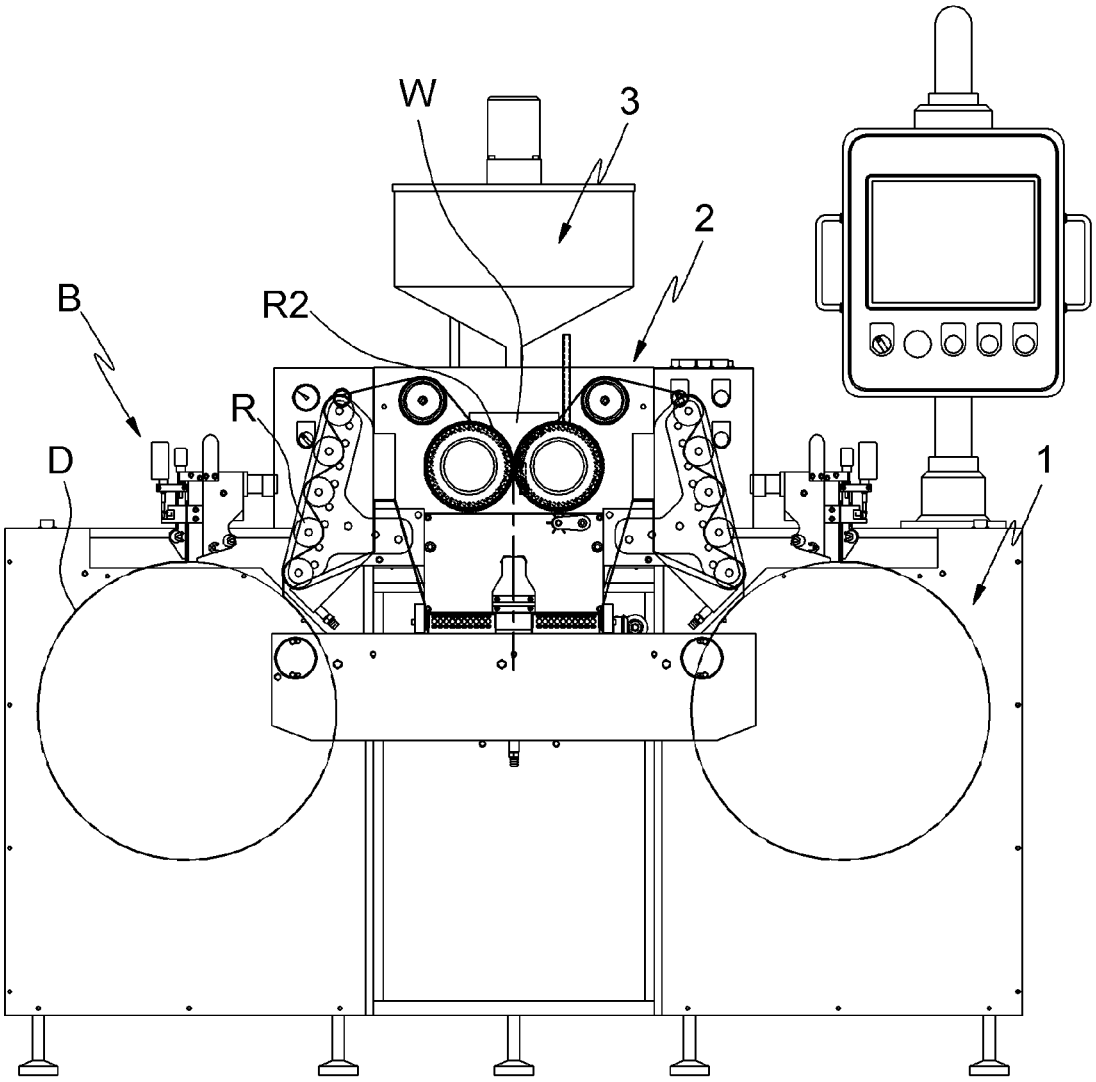
FIG. 1 Prior Art
FIG. 1 is a schematic view illustrating a softgel encapsulation machine of the related art.
Figure 3A:
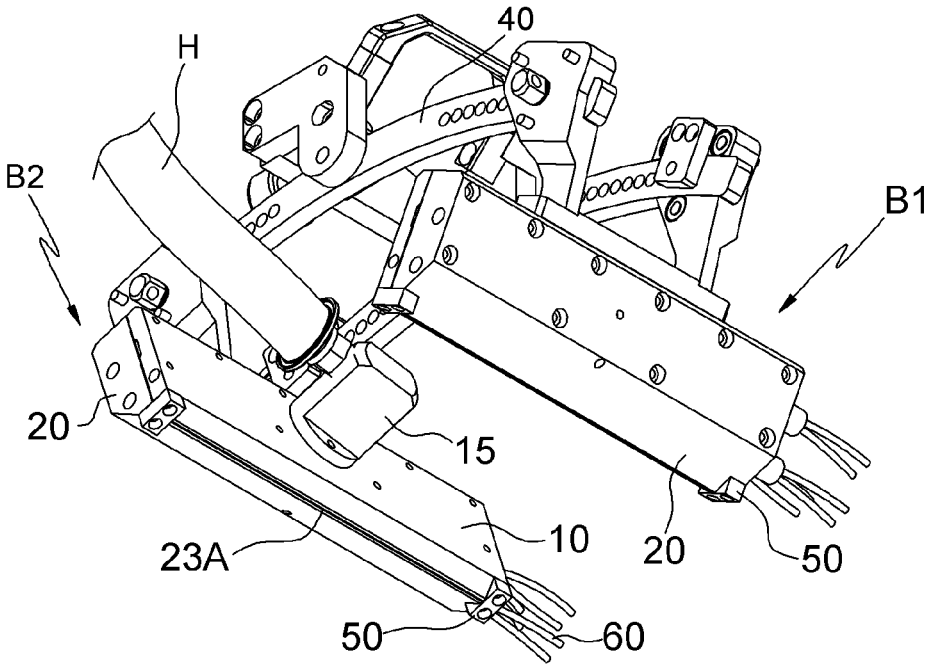
FIGS. 3A and 3B are schematic views illustrating the gelatin supply device according to the present invention.
Figure 3B:
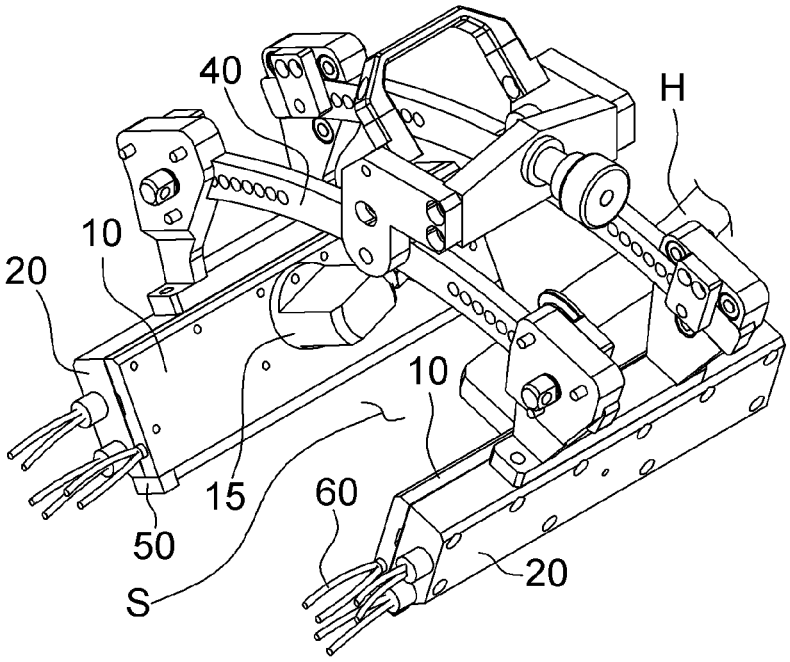
Figure 4A:
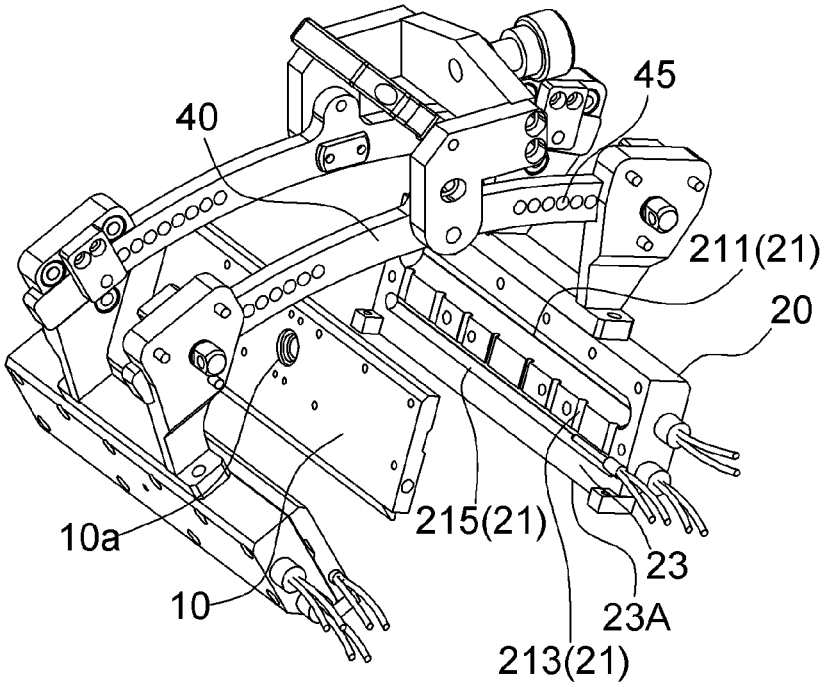
FIGS. 4A and 4B are schematic views illustrating a state where a spreader box is separated from the gelatin supply device according to the present invention.
Figure 4B:
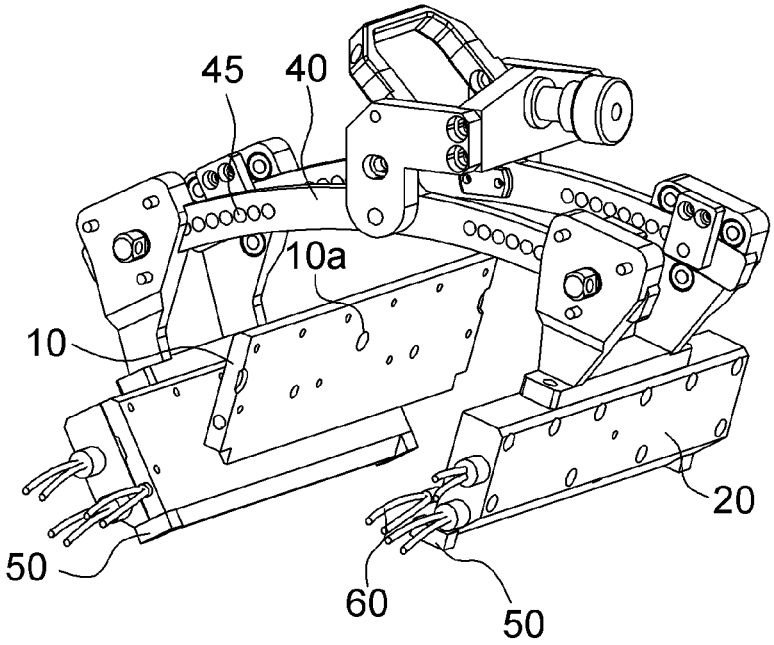
Figure 5:
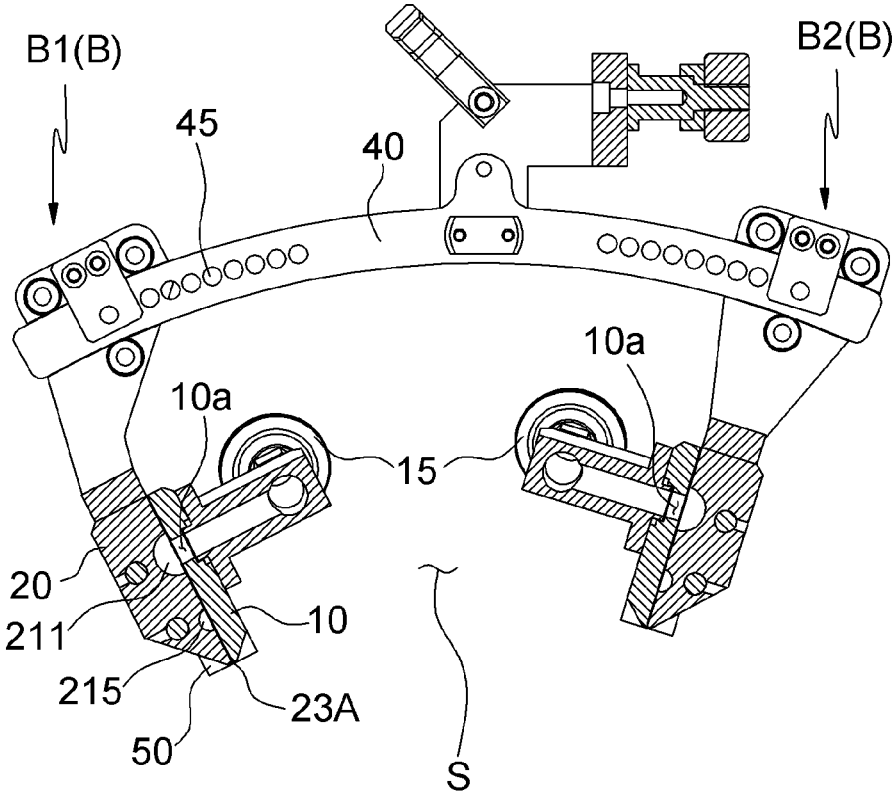
FIG. 5 is a cross-sectional view illustrating the gelatin supply device according to the present invention.

FIGS. 3A and 3B are schematic views illustrating the gelatin supply device having the spreader boxes according to the present invention. As illustrated in FIG. 2, the gelatin supply device having the spreader boxes (B) illustrated in FIG. 1 is replaced with the gelatin supply device of the present invention having the spreader boxes illustrated in FIGS. 3A and 3B.

Although the conventional gelatin supply device having the spreader boxes is replaced with the gelatin supply device having the spreader boxes according to the present invention, the softgel encapsulation machine still operates, and the size of the conventional softgel encapsulation machine is maintained. Accordingly, there is no space limitation in accordance with use of the softgel encapsulation machine.

As will be described later, even when forming a multi-ply shell consisting of gelatin sheets, the spreader box structure of the present invention can be employed in an existing space without the need of an additional space.

Although the two spreader boxes for each drum are illustrated in FIG. 2, the number of spreader boxes for each drum is not limited to two, and multiple spreader boxes having the same structure may be arranged in the vicinity of the outer circumferential surfaces of each of the drums of the sheet forming portion.

Next, the spreader boxes will be described in detail with reference to FIGS. 2 to 5.

Each of the two spreader boxes, i.e., a first spreader box (B1) and a second spreader box (B2), is positioned in the vicinity of the outer circumferential surface of each of the drums by a guide 40. As will be described later, the guide 40 is spaced from the outer circumferential surface of each of the drums (D) and arc-shaped concentric with each of the drums (D). The guide 40 allows a distance between the two spreader boxes (B1) and (B2) to be adjusted.

The first spreader box (B1) and the second spreader box (B2) have the same structure. Hereinafter, the structure of the spreader boxes according to the present invention will be described with reference to the first spreader box (B1) of one of the drums.

The first spreader box includes an inner block 10 and an outer block 20, and is configured with a uniform width outlet between the inner block 10 and the outer block 20 by a machined step.

The inner block 10 is configured with an inlet hole 10*a* through which the liquid gelatin pumped in the storage tank is supplied by the transfer hose (H) into the spreader box. The liquid gelatin supplied through the inlet hole 10*a* of the inner block is transferred to a discharge passage 21 configured in the outer block 20. Then, the liquid gelatin is discharged to the outer circumferential surface of the drum in the form of a sheet through the discharge passage and is applied to the outer circumferential surface of the drum.

The inlet hole 10*a* is preferably configured in the central portion of the inner block, rather than in the left side or right side of the inner block.

The liquid gelatin supplied through the inlet hole 10*a* configured in the central portion flows into the central portion of the discharge passage 21 of the outer block 20 without being concentrated on either one of the left and right sides of the outer block 20, and is discharged to the outer circumferential surface of the drum through an outlet 23.

An outlet end 23A of the outlet 23 is spaced apart from the outer circumferential surface of the drum. Guide blocks designed to be brought into contact with the outer circumferential surface of the drum are provided on opposite sides of the bottom surface of the spreader box, that is, on opposite sides of a portion where the outlet 23 is configured, to ensure a stable mounting state of the spreader box with respect to the drum.

The guide blocks 50 are made of Teflon.

A space is defined between the outer circumferential surface of the drum and the outlet end of the spreader box by the height of the guide blocks 50. Accordingly, the liquid gelatin is discharged to the space in the form of a sheet, applied on the outer circumferential surface of the drum, and cooled, so that the gelatin is formed into a gelatin sheet.

The thickness of the capsule shell is required to be set according to purposes or functions of the capsule product finally produced in the softgel encapsulation machine. Since the thickness of the capsule shell is determined in the process of forming the liquid gelatin into the form of a sheet, the gelatin supply device according to the present invention adopts a configuration capable of adjusting the thickness of the gelatin sheet.

In the related art, Korean Patent No. 10-1580825, a blocking plate is slid up and down to adjust a size of an outlet end through which liquid gelatin is discharged from a spreader box, thereby adjusting the thickness of a gelatin sheet. However, since the blocking plate is slid up and down, configurations thereof are complicated and the use thereof is not simple.

Accordingly, the present invention is to adjust the thickness of the gelatin sheet by means of a simple method. For this purpose, a known gear pump is used for supplying the liquid gelatin from the storage tank to the spreader box.

A gear pump uses the meshing of two gears and displaces fluid confined in teeth of the gears and the space between the gears along an inner surface of a casing by rotations of the gears. A flow rate to be discharged is proportional to the number of revolutions of the gears. Therefore, it is possible to supply the liquid gelatin to the spreader box in a predetermined amount and possible to control the flow rate by the number of revolutions of the gears.

In addition, the drum of the sheet forming portion is controlled in rotation speed.

As a result, the thickness of the gelatin sheet applied to the outer circumferential surface of the drum is adjusted by the rotational speed of the drum and the amount of gelatin constantly discharged by the gear pump to the outer circumferential surface of the drum.

That is, in the present invention, the gear pump is used to maintain a predetermined amount of gelatin discharged from the spreader box and applied to the outer circumferential surface of the drum, and the rotational speed of the drum is controlled to adjust the thickness of the gelatin sheet. For example, when the drum rotates at a high speed, a thin gelatin sheet can be obtained. On the contrary, when the drum rotates at a slow speed, a thick gelatin sheet can be obtained.

Next, the discharge passage 21 configured in the outer block will be described.

The discharge passage includes: a first storage 211 where the liquid gelatin supplied through the inner block is transferred and primarily stored in the outer block; transfer passages 213 providing a pathway to transfer the liquid gelatin downward which is stored in the first storage 211; a second storage 215 where the liquid gelatin supplied through the transfer passages 213 is stored; and the outlet 23 through which the liquid gelatin is discharged to be applied on the outer circumferential surface of the drum in the form of a sheet.

The second storage 215 is configured to be smaller in size than the first storage 211. It is preferable that the transfer passages 213 are configured to be narrow and multiple transfer passages 213 are arranged at the end of the first storage 211 so that the liquid gelatin is transferred from the first storage 211 to the second storage 215.

The first spreader box (B1) and the second spreader box (B2) according to the present invention are arranged such that the inner block 10 of the first spreader box (B1) and the inner block 10 of the second spreader box (B2) face each other and each outer blocks 20 of each of the spreader boxes are positioned outwardly. Accordingly, the liquid gelatin is supplied to the spreader boxes through a space (S) defined by the two spreader boxes facing each other.

This is for arranging the two spreader boxes within a limited space, and when disposing the two spreader boxes, a space between the spreader boxes is inevitable. Accordingly, the present invention provides an inlet portion for supplying the liquid gelatin into the spreader boxes by using the space (S).

Since the two spreader boxes is required to be mounted in a limited space, the present invention modifies a structure of the spreader box which has been mainly employed in the conventional gelatin supply device. That is, the conventional gelatin supply device generally employs the spreader box structure having a hollow portion of a predetermined size, but according to the structure, it is difficult to mount two spreader boxes in a limited space. Thus, in the present invention, the spreader box is constituted by the outer block 20 configured with the discharge passage 21 and the inner block 10 as described above, thereby reducing the size of the spreader box and minimizing the size of the device.

The inlet portion includes: the inlet hole 10*a* configured in the inner block 10; and a mounting means 15 communicating the transfer hose and the inlet hole 10*a* each other so that the liquid gelatin transferred through the transfer hose is supplied to the inlet hole 10*a*.

A heater 60 is inserted into the outer block 20 having the discharge passage 21 to induce smooth transfer and discharge of the liquid gelatin.

Next, the guide 40 which is provided to adjust the distance between the two spreader boxes will be described.

Controlling the timing of applying the liquid gelatin discharged from the spreader box to the outer circumferential surface of the drum is required in consideration of a state of the gelatin sheet applied on the drum and cooled. The timing is controlled by adjusting the distance between the two spreader boxes.

In the present invention, the guide 40 is provided, and the spreader boxes are provided at opposite ends of the guide 40 such that the spreader boxes can be moved along the guide 40, thereby adjusting the distance between the two spreader boxes. In other words, at the opposite ends of the guide on which the spreader boxes are placed, multiple adjustment holes 45 are configured to vary the position of the spreader boxes so that the distance between the two spreader boxes is adjusted by placing the spreader boxes to desired adjustment holes. The configuration for placing the spreader boxes to the guide or the configuration for adjusting the distance between the spreader boxes may adopt a known manner other than the manner mentioned above.

It is preferable that the adjustment holes 45 configured in the guide 40 are arranged in an arc shape being a concentric with the drum (D) disposed below. Even though the distance between the spreader boxes (B) is adjusted through the adjustment holes, the distance initially set between the outlet where the liquid gelatin is discharged from the spreader box and the outer circumferential surface of the drum remains the same.

The multiple adjustment holes 45 may be configured and arranged in an arc shape or may be configured into one arc-shaped long slot being concentric with the drum disposed below.

Figure 6:
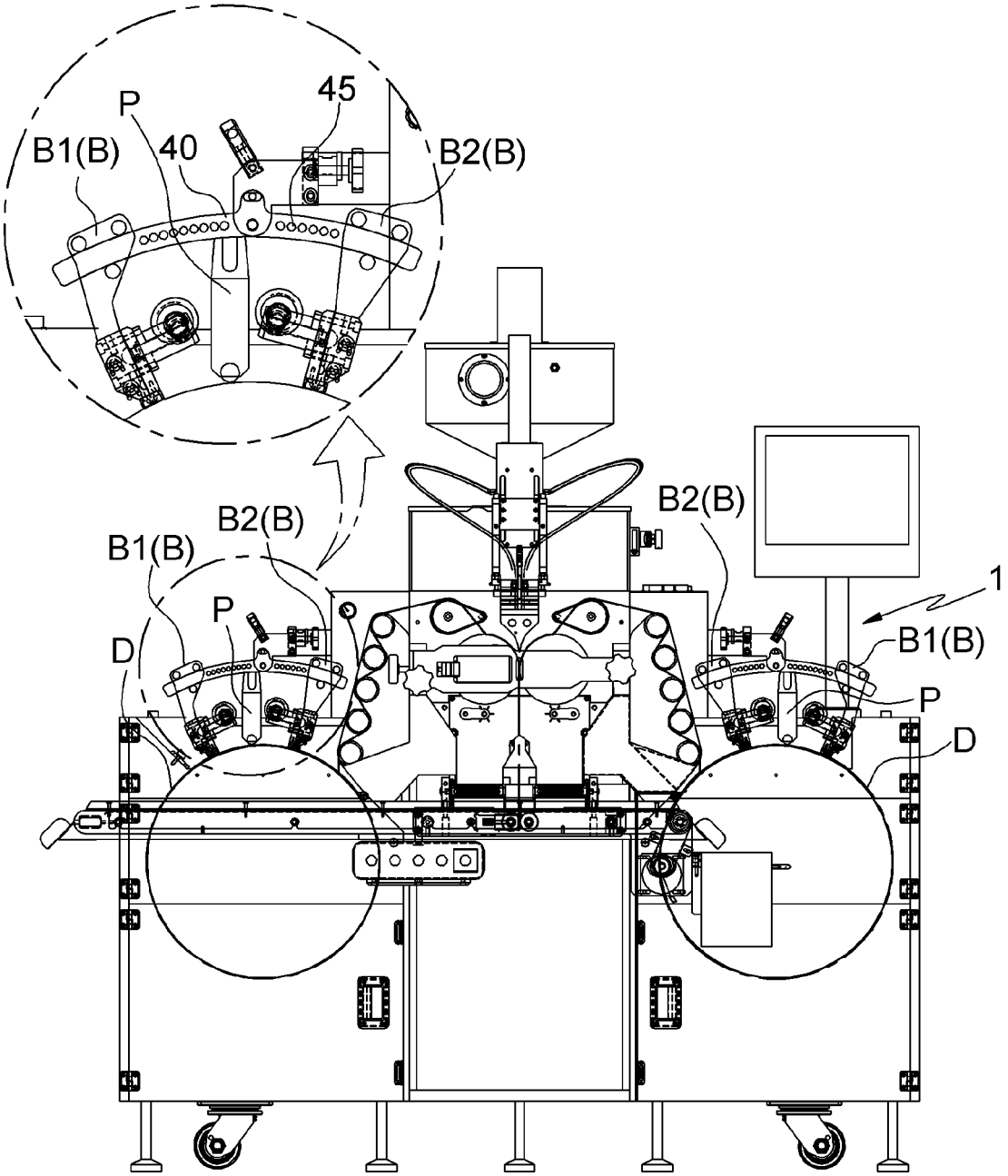
FIG. 6 is a schematic view illustrating the softgel encapsulation machine equipped with a gelatin supply device equipped with a printing unit according to the present invention.
Figure 7:
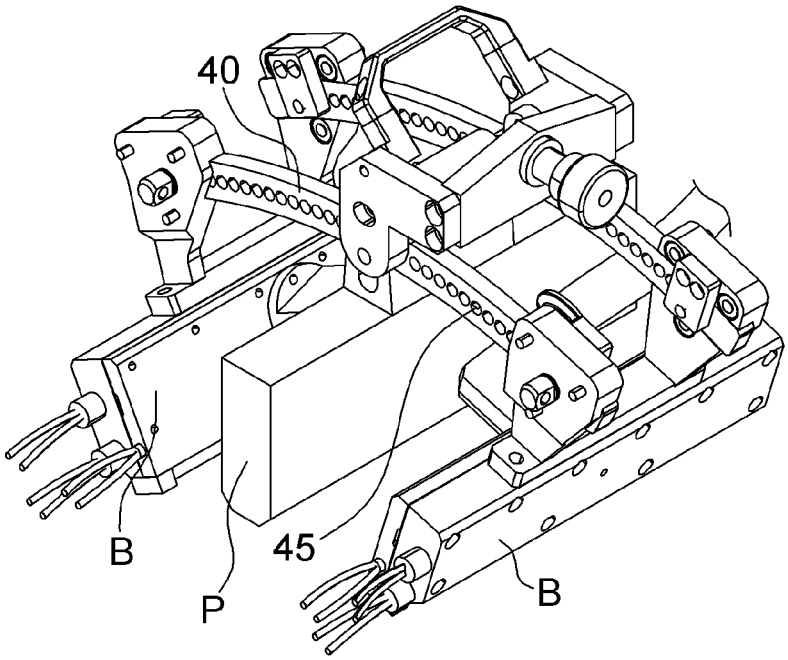
FIG. 7 is a schematic view illustrating the gelatin supply device of FIG. 6.

As illustrated in FIGS. 6 and 7, the gelatin supply device having the above-described configuration according to the present invention may further include a printing unit (P) between the spreader boxes (B).

As illustrated in FIGS. 6 and 7, the gelatin supply device according to the present invention produces a soft capsule having a multi-ply shell and provides various information marks printed between the gelatin sheets consisting the shell. That is, it is another important point of the present invention in that the gelatin supply device is capable of printing an information mark while forming the multiple gelatin sheets.

Figure 8A:
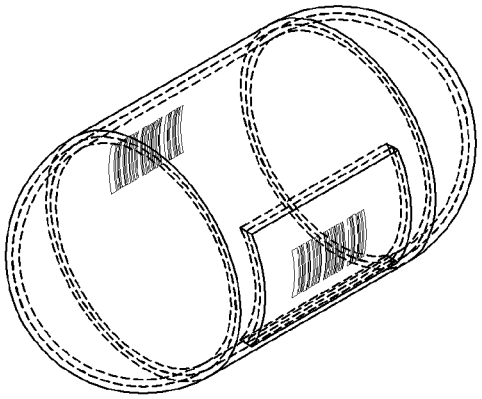
FIGS. 8A and 8B are views illustrating a soft capsule manufactured by the softgel encapsulation machine of FIG. 6.
Figure 8B:
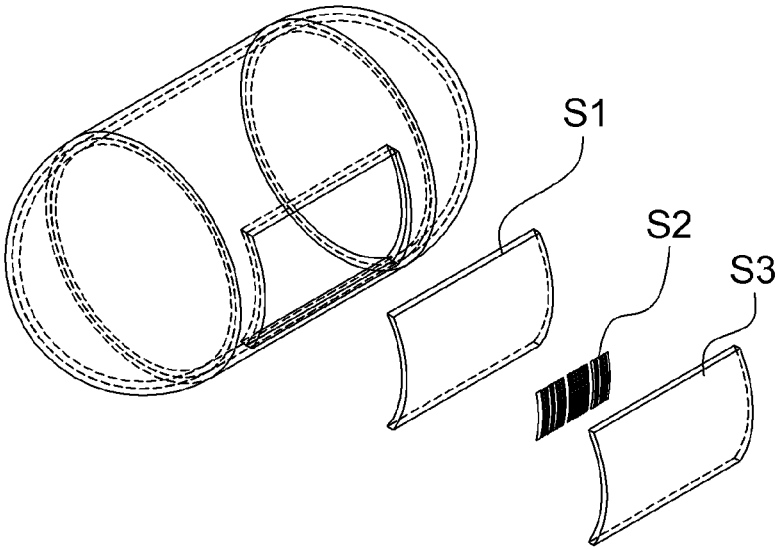

As illustrated in FIGS. 8A and 8B, it is possible to obtain a soft capsule having a multi-ply or double-ply shell, in which an information mark (S2) including lot numbers or characters of the medicine or pharmaceutical company of the medicine is formed and displayed on an inner-ply shell (S1), and in which the information mark is covered by an outer-ply shell (S3) located outside whereby the information mark can be maintained without being damaged.

Accordingly, the gelatin supply device according to the present invention has the following configuration.

In detail, the gelatin supply device according to the present invention includes: the spreader boxes (B) supplying the liquid gelatin in the form of a sheet as the gelatin supply device of the conventional softgel encapsulation machine does; a storage tank (not illustrated) where the liquid gelatin is stored; and transfer hoses (H) through which the stored liquid gelatin is supplied to the spreader boxes. Two or more spreader boxes (B) are provided spaced apart from each other by a predetermined distance, and the printing unit (P) is provided between the spreader boxes (B) to print and make the information mark.

The multiple spreader boxes (B) are arranged in a manner maintaining an appropriate distance between the respective spreader boxes (B) in the vicinity of the outer circumferential surface of the drum, and directly supply the liquid gelatin to the outer circumferential surface of the drum in the form of a sheet.

The printing unit (P) provided between the spreader boxes (B) prints necessary information on a surface of the gelatin sheet moved along the outer circumferential surface of the drum to make the information mark.

Although the two spreader boxes for each drum are illustrated in FIGS. 6 and 7, the number of spreader boxes for each drum is not limited to two, but multiple spreader boxes having the same structure may be arranged in the vicinity of the outer circumferential surfaces of each of the drums of the sheet forming portion.

In the case the two spreader boxes (B) are provided, the printing unit (P) is disposed between the spreader boxes (B). In the case three or more spreader boxes (B) are provided, the printing unit (P) is preferably disposed between the outermost spreader box (B) and the adjacent spreader box (B). In other words, the spreader boxes and the printing unit are arranged from the outside to the inside in the order: spreader box-printing unit-spreader box-spreader box.

This is because it is preferable that the information mark formed by the printing unit is clearly visible while being covered with a single layer of gelatin sheet on top of the information mark to prevent damage to the information mark.

Considering the configuration of the capsule molding portion of the conventional softgel encapsulation machine, the printing unit (P) is preferably disposed at the inner side of the outermost spreader box (B) because a gelatin sheet supplied by the outermost spreader box (B) is located at the outermost side of a multi-ply shell of a soft capsule.

Referring back to FIGS. 6 and 7, each of the two spreader boxes, i.e., the first spreader box (B1) and the second spreader box (B2), is positioned in the vicinity of the outer circumferential surface of each of the drums by the guide 40. Between the first spreader box (B1) and the second spreader box (B2), the printing unit (P) is also positioned in the vicinity of the outer circumferential surface of the drum (D) by the guide 40.

The guide 40 is spaced apart from the outer circumferential surface of the drum (D) and arc-shaped concentric with the drum (D). The guide 40 allows distances between the two spreader boxes (B1) and (B2) and the printing unit (P) to be adjusted.

In the gelatin supply device illustrated in FIG. 2 and described above, the printing unit (P) is additionally provided on the guide 40. The configuration of the gelatin supply device other than the printing unit (P) is the same as that of the gelatin supply device described above.

An operation of the softgel encapsulation machine having the gelatin supply device according to the present invention constructed as described above is achieved as follows.

The softgel encapsulation machine illustrated in FIGS. 6 and 7 is for molding a soft capsule having two-ply shell (S1 and S3) illustrated in FIGS. 8A and 8B.

The gelatin liquefying from the gelatin tank is supplied each of the spreader boxes (B) connected to the respective storage tank and a transfer hose, adjusted in thickness from the spreader box (B), and applied to the outer circumferential surface of the drum (D) in an adjusted thickness.

Here, a gelatin sheet applied by the first spreader box (B1) disposed at the outer side of the softgel encapsulation machine becomes an outer-ply shell of a soft capsule, and a gelatin sheet applied by the second spreader box (B2) disposed at the inner side of the softgel encapsulation machine becomes an inner-ply shell of the soft capsule.

The printing unit (P) disposed between the first spreader box (B1) and the second spreader box (B2) prints various information on the gelatin sheet, which corresponds to the inner-ply shell (S1) of the soft capsule and is applied to the outer circumferential surface of the drum by the second spreader box (B2), to make the information mark (S2). Then, a gelatin sheet, which corresponds to the outer-ply shell (S3) of the soft capsule and is applied to the outer circumferential surface of the drum by the first spreader box (B1), covers the information mark S2 formed on a surface of the gelatin sheet, which is the outer-ply shell of the soft capsule and moved along the outer circumferential surface of the drum.

As a result, the two gelatin sheets where the information mark S2 is interposed are transferred along the outer circumferential surface of the drum, and then introduced into the capsule molding portion 2 to mold the soft capsule.

Here, transparent liquid gelatin is supplied to the first spreader box (B1) to form the outer-ply shell (S3) of the soft capsule as a transparent layer so that the information mark (S2) printed on the surface of the inner-ply shell can be more accurately visible.

Since the outer-ply shell of the molded soft capsule protects the shell surface of the molded soft capsule, a printing liquid discharged by the printing unit (P) may contain a liquid medicine component. The liquid gelatin constituting the inner-ply shell (S1) may also contain a liquid medicine component. According to the present invention, a desired liquid medicine component can be stored not only in the capsule but also in the information mark or the gelatin sheet whereby two or more medicine components in one capsule can be realized.

As described above, the present invention has been described with reference to the accompanying drawings. However, those skilled in the art will appreciate that various modifications, additions and substitutions are possible, without departing from the scope and spirit of the invention as disclosed in the accompanying claims.

What is claimed:

1. A gelatin supply device for a softgel encapsulation machine, the device supplying liquid gelatin to a drum in a form of a sheet and cooling the liquid gelatin to mold a gelatin sheet, the device comprising:

two spreader boxes supplying the liquid gelatin in the form of a sheet;

a storage tank where the liquid gelatin is stored; and a transfer hose through which the stored liquid gelatin is transferred to the two spreader boxes, wherein the two spreader boxes are provided to form two gelatin sheets and provided on a guide provided on an upper surface of the drum, and adjustment holes configured in the guide are arranged in an arc shape being concentric with the drum such that the two spreader boxes provided on the guide are moved due to the adjustment holes to adjust a distance between the two spreader boxes, and wherein the two spreader boxes are disposed in the vicinity of an outer circumferential surface of the drum, and an inlet portion is provided in each surface of the two spreader boxes facing each other to supply the liquid gelatin into the two spreader boxes.

2. The device of claim 1, wherein the liquid gelatin is supplied by an operation of a gear pump from the storage tank to the two spreader boxes.

3. The device of claim 1, wherein each of the two spreader boxes includes:

an inner block having an inlet hole through which the liquid gelatin supplied through the transfer hose is supplied into the each of the two spreader boxes; and an outer block communicating with the inlet hole to supply the liquid gelatin and configured with a discharge passage to discharge the supplied liquid gelatin to the outer circumferential surface of the drum.

4. The device of claim 1, further comprising:

a printing unit between the two spreader boxes to print an information mark, wherein the information mark is positioned between the two gelatin sheets.

5. The device of claim 4, wherein the printing unit is provided on the guide.

6. The device of claim 4, wherein the information mark printed on the two gelatin sheets by the printing unit is made of a liquid medicine component.

7. A gelatin supply device for a softgel encapsulation machine, the device supplying liquid gelatin to a drum in a form of a sheet and cooling the liquid gelatin to mold a gelatin sheet, the device comprising:

at least two spreader boxes supplying the liquid gelatin in the form of a sheet;

a storage tank where the liquid gelatin is stored; and a transfer hose through which the stored liquid gelatin is transferred to the at least two spreader boxes, wherein the at least two spreader boxes are provided to form multiple gelatin sheets and provided on a guide provided on an upper surface of the drum, and adjustment holes configured in the guide are arranged in an arc shape being concentric with the drum such that the at least two spreader boxes provided on the guide are moved due to the adjustment holes to adjust a distance between the at least two spreader boxes, and wherein each of the at least two spreader boxes includes:

an inner block having an inlet hole through which the liquid gelatin supplied through the transfer hose is supplied into the each of the at least two spreader boxes; and an outer block communicating with the inlet hole to supply the liquid gelatin and configured with a discharge passage to discharge the supplied liquid gelatin to the outer circumferential surface of the drum.

8. A gelatin supply device for a softgel encapsulation machine, the device supplying liquid gelatin to a drum in a form of a sheet and cooling the liquid gelatin to mold a gelatin sheet, the device comprising:

at least two spreader boxes supplying the liquid gelatin in the form of a sheet;

a storage tank where the liquid gelatin is stored;

a transfer hose through which the stored liquid gelatin is transferred to the at least two spreader boxes; and a printing unit between the at least two spreader boxes to print an information mark, wherein the at least two spreader boxes are provided to form multiple gelatin sheets and provided on a guide provided on an upper surface of the drum, and adjustment holes configured in the guide are arranged in an arc shape being concentric with the drum such that the at least two spreader boxes provided on the guide are moved due to the adjustment holes to adjust a distance between the at least two spreader boxes, and wherein the information mark is positioned between the multiple gelatin sheets.

9. The device of claim 8, wherein the printing unit is provided on the guide.

10. The device of claim 8, wherein the information mark printed on the multiple gelatin sheets by the printing unit is made of a liquid medicine component.

* * * * *